US008408108B2

(12) United States Patent
Redemann et al.

(10) Patent No.: US 8,408,108 B2
(45) Date of Patent: Apr. 2, 2013

(54) SYSTEMS AND METHODS FOR SLICING FOOD PRODUCTS

(75) Inventors: Rory J. Redemann, Lodi, WI (US); Timothy T. Watson, Waunakee, WI (US)

(73) Assignee: Kraft Foods Group Brands LLC, Northfield, IL (US)

( * ) Notice: Subject to any disclaimer, the term of this patent is extended or adjusted under 35 U.S.C. 154(b) by 513 days.

(21) Appl. No.: 12/704,972

(22) Filed: Feb. 12, 2010

(65) Prior Publication Data

US 2011/0197728 A1 Aug. 18, 2011

(51) Int. Cl.
*B26D 5/20* (2006.01)

(52) U.S. Cl. ..... 83/356; 83/401; 83/932

(58) Field of Classification Search ..... 83/350, 83/355, 356, 401, 932, 373
See application file for complete search history.

(56) References Cited

U.S. PATENT DOCUMENTS

| | | | | |
|---|---|---|---|---|
| 3,442,312 | A | 5/1969 | Karp | |
| 3,613,754 | A | 10/1971 | Hartley | |
| 3,771,404 | A | 11/1973 | Richards | |
| 3,910,141 | A * | 10/1975 | Divan | 83/26 |
| 4,608,892 | A | 9/1986 | Noizet | |
| 5,172,328 | A * | 12/1992 | Cahlander et al. | 700/211 |
| 5,342,236 | A * | 8/1994 | Repisky et al. | 452/149 |
| 5,422,130 | A * | 6/1995 | Fox et al. | 426/234 |
| 5,493,957 | A * | 2/1996 | Kennedy et al. | 99/450.4 |
| 5,509,337 | A | 4/1996 | Norman | |
| 5,517,904 | A * | 5/1996 | Vargas et al. | 99/450.1 |
| 5,590,591 | A * | 1/1997 | Kim | 99/544 |
| 5,666,866 | A | 9/1997 | Huang | |
| 5,687,626 | A | 11/1997 | Scherch | |
| 7,073,421 | B1 | 7/2006 | Verhalen | |
| 2003/0070525 | A1 | 4/2003 | Barnhart | |
| 2006/0150791 | A1 | 7/2006 | Chase | |
| 2007/0062353 | A1 | 3/2007 | Bodey et al. | |
| 2008/0016999 | A1 | 1/2008 | Mathues | |
| 2008/0083310 | A1 | 4/2008 | Verhalen | |
| 2009/0173196 | A1 | 7/2009 | Lindee | |
| 2010/0095819 | A1 * | 4/2010 | Brazier | 83/356 |
| 2011/0232505 | A1 * | 9/2011 | Rosenwirth et al. | 99/484 |
| 2012/0064202 | A1 * | 3/2012 | Kloepping et al. | 426/231 |
| 2012/0108155 | A1 * | 5/2012 | Bolte et al. | 452/134 |

FOREIGN PATENT DOCUMENTS

| | | |
|---|---|---|
| EP | 1897664 | 12/2008 |
| FR | 2 688 732 A1 | 9/1993 |

OTHER PUBLICATIONS

Extended European Search Report issued by the European Patent Office on May 16, 2011 regarding European Patent Application No. 11154064.7.

* cited by examiner

*Primary Examiner* — Sean Michalski
(74) *Attorney, Agent, or Firm* — Fitch, Even, Tabin & Flannery LLP

(57) ABSTRACT

Systems and methods are provided for cutting slices of food product from a larger portion of the food product, whereby the systems and methods can reduce down-time associated with some of the portions of the equipment during cleaning. Components of the system requiring more frequent cleaning can be readily disconnected from those components requiring less frequent cleaning. Further, substitute components can be connected to those components requiring less frequent cleaning to reduce their down-time while the other components are being cleaned.

10 Claims, 2 Drawing Sheets

SYSTEMS AND METHODS FOR SLICING FOOD PRODUCTS

FIELD

Systems and methods are described herein relating to cutting slices of food product from a larger portion of the food product and, in particular, systems and methods configured for simplified cleaning.

BACKGROUND

In the formation of food product slices, one common method is to advance a larger portion of the food product to a slicing blade. The advancement of the food product in conjunction with the rotation of the slicing blade results in slices of food product being cut from the larger portion of the food product. Typical types of food products that are sliced include meats and cheeses. For example, cheese slices may be cut from an end of a larger portion of cheese. Also by way of example, meat slices may be cut from an end of a larger portion of meat, such as bacon slices from a pork belly or deli meat slices from a meat log.

Various configurations of equipment can be used for the formation of food product slices from a larger portion of the food product. This equipment can include a machinery framework supporting a slicing blade, a motor and a shaft operably connected between the slicing blade and the motor for driving the slicing blade for rotation using the motor. The equipment can also include a conveyor, such as a belt conveyor, for advancing the larger portion of the food product to the slicing blade. A motor can be associated with the conveyor for driving the conveyor.

In high speed commercial production, a controller can be used to synchronize the operation of the components on the framework. For example, a controller can be used to control the motor operably connected to the slicing blade and to control the operation of the conveyor. The controller can adjust the speeds of the motors to control the thickness of the sliced food product, such as by speeding up or slowing down the speeds of the motors to thereby control the speeds of the slicing blade and the conveyor. The controller can also be connected to other electronic components of the platform, such as sensors for sensing the position of the larger portion of the food product and sensors for sensing the speeds of the motors.

Depending upon the specific type of equipment arrangement, differing in-feed mechanisms can be used. One type of in-feed mechanism is a hold-down drive roller, driven for rotation. Another type of in-feed mechanism is a gripper supported by a cantilevered arm, which arm is movable. Yet another type of in-feed mechanism is a pusher associated to move with the conveyor belt.

Many of the surfaces of the platform and its components that come into contact with the food product are periodically cleaned. For instance, the slicer blade, an associated housing, and the conveyor can come in contact with the food product and be periodically cleaned. As the components are supported by the framework, operation of the entire piece of equipment is halted so that some of the components can be cleaned. This disadvantageously results in unnecessary down-time for components that do not need to be cleaned or need cleaning on less frequent bases. Furthermore, care is taken during cleaning so as to not damage the electronic components associated with the framework, such as the sensors, motors and controller. Protecting the electronic components during cleaning can increase the time associated with the cleaning process, thereby disadvantageously increasing the down-time of the equipment. For example, the electronic components can be wrapped or otherwise protect, or certain components can be removed from the framework, both of which can add to the down-time of the equipment.

Attempts have been made to simplify cleaning of food slicing equipment. In one example, heat treatments can be applied to the exterior of the equipment in order to avoid having to disassemble. However, such exterior heat treatments can require significant preparation work, thereby disadvantageously contributing to down-time of the equipment. In another example, a hot air heater can be associated with a target area, such as the slicing blade, for cleaning purposes. However, the hot air heater can disadvantageously create a heated zone adjacent to the target area.

SUMMARY

A system for slicing food products from a larger portion of a food product is provided, whereby the system is configured for simplified cleaning or sterilization. The simplified cleaning can advantageously result in reduced down-time of the system, thereby providing for improved efficiencies in commercial production of food slices, including improved shelf life.

In one aspect, those portions of the food processing systems for which more frequent cleaning is desired can be readily separable from those portions which do not require the same frequency of cleaning. Regions of the system that regularly come into contact with the food product, such as the conveyor and the slicing blade, can be in modular form with respect to regions of the system that do not need as frequent cleaning and/or electronic components, such as motors, controllers and sensors. This advantageously permits select components to be readily disconnected from other components to facilitate cleaning. Further, separating at least some of the electronic components from those requiring more frequent cleaning can simplify the cleaning because the electronic components do not need to be specially protected in order to clean the components requiring more frequent cleaning, as they can simply be disconnected or otherwise isolated and remain with the regions of the system that do not need as frequent cleaning.

A further advantage is that when the module containing the components needing more frequent cleaning is separated from the remainder of the system, a substitute module can be operably connected to the remainder of the system. This reduces the down-time associated with the remainder of the system, permitting the remainder of the system to be operational using the substitute module while the original module is being cleaned. This can result in significant maximization of the use of the remainder of the system.

In another aspect, those portions of the food processing systems for which more frequent heating and/or cleaning is desired can be readily separable from electronic components. This advantageously permits for the cleaning of certain components without the preparations necessary to protect the electronic components during cleaning. For instance, drive mechanisms can either be moved from the product contact areas, isolated from the product contact areas, or associated with the equipment requiring less frequent cleaning.

In yet another aspect, the system can include localized cleaning systems, such as integrated heating elements, for cleaning specific areas of the system without adversely impacting adjacent areas. The localized cleaning systems can be disposed adjacent areas of the system where there is the potential for interaction between areas that regularly come into contact with food products and those areas that do not regularly come into contact with food products during routine food processing operations. Localized heating elements can be disposed proximate seals, supports, gaps (such as areas lacking continuous welds) and the like for cleaning those specific areas, while being configured so as to not significantly heat adjacent areas.

DETAILED DESCRIPTION

Figure 1:
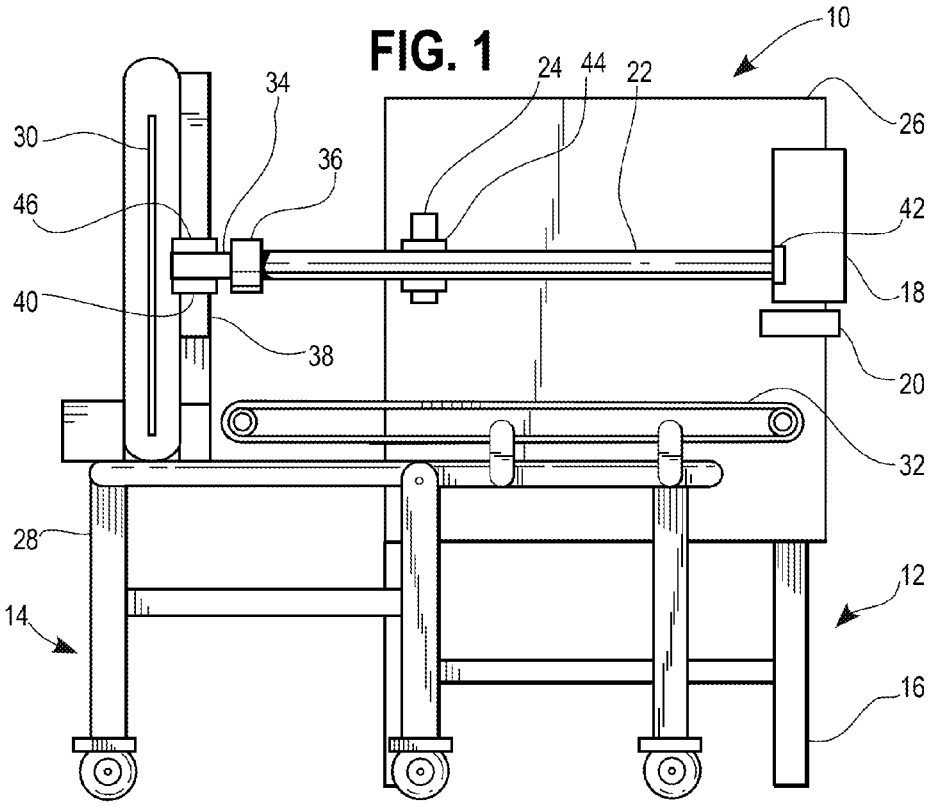
FIG. 1 is a schematic side elevation view of a system configured for simplified cleaning or sanitization, including a first platform with a slicing blade and a conveyor, a second platform with a motor, and a shaft operably connected between the motor and the slicing blade, as well as a plurality of integrated heating elements adjacent the shaft.
Figure 2:
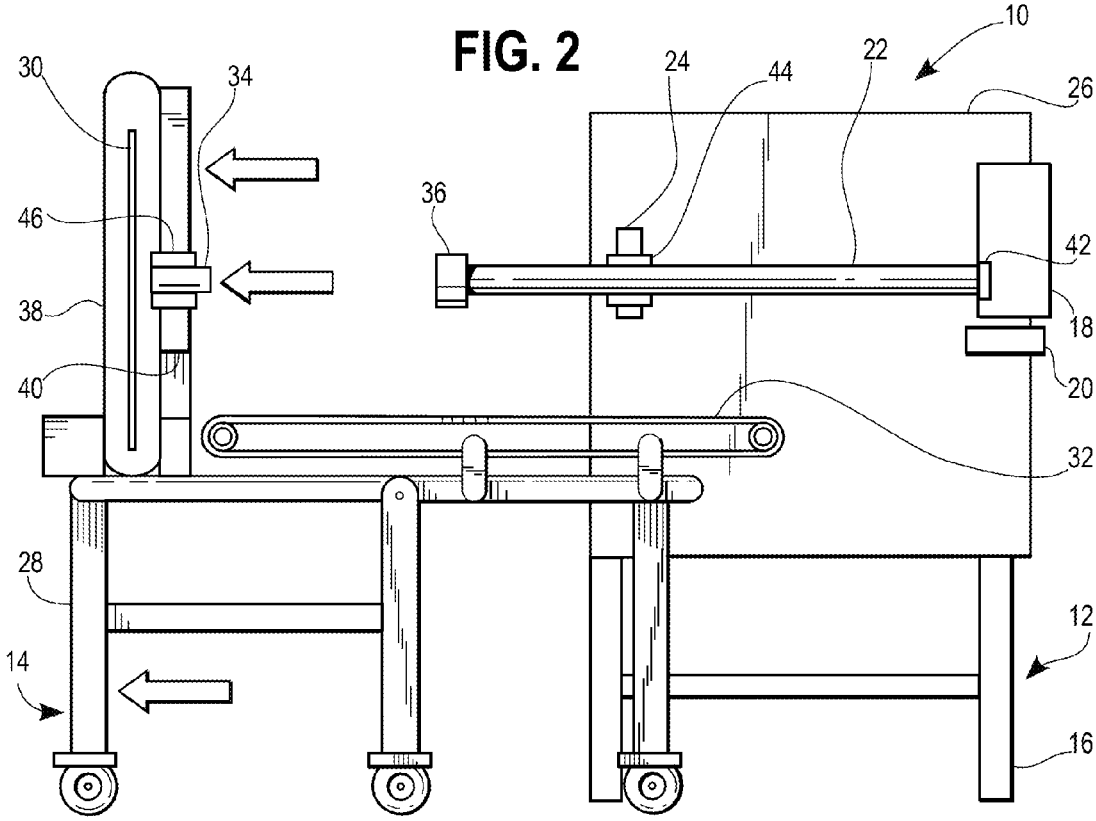
FIG. 2 is a schematic side elevation view of the system of FIG. 1, but showing the shaft disconnected and the first platform, along with the slicing blade and the conveyor, and the second platform, along with the motor, moved apart.
Figure 3:
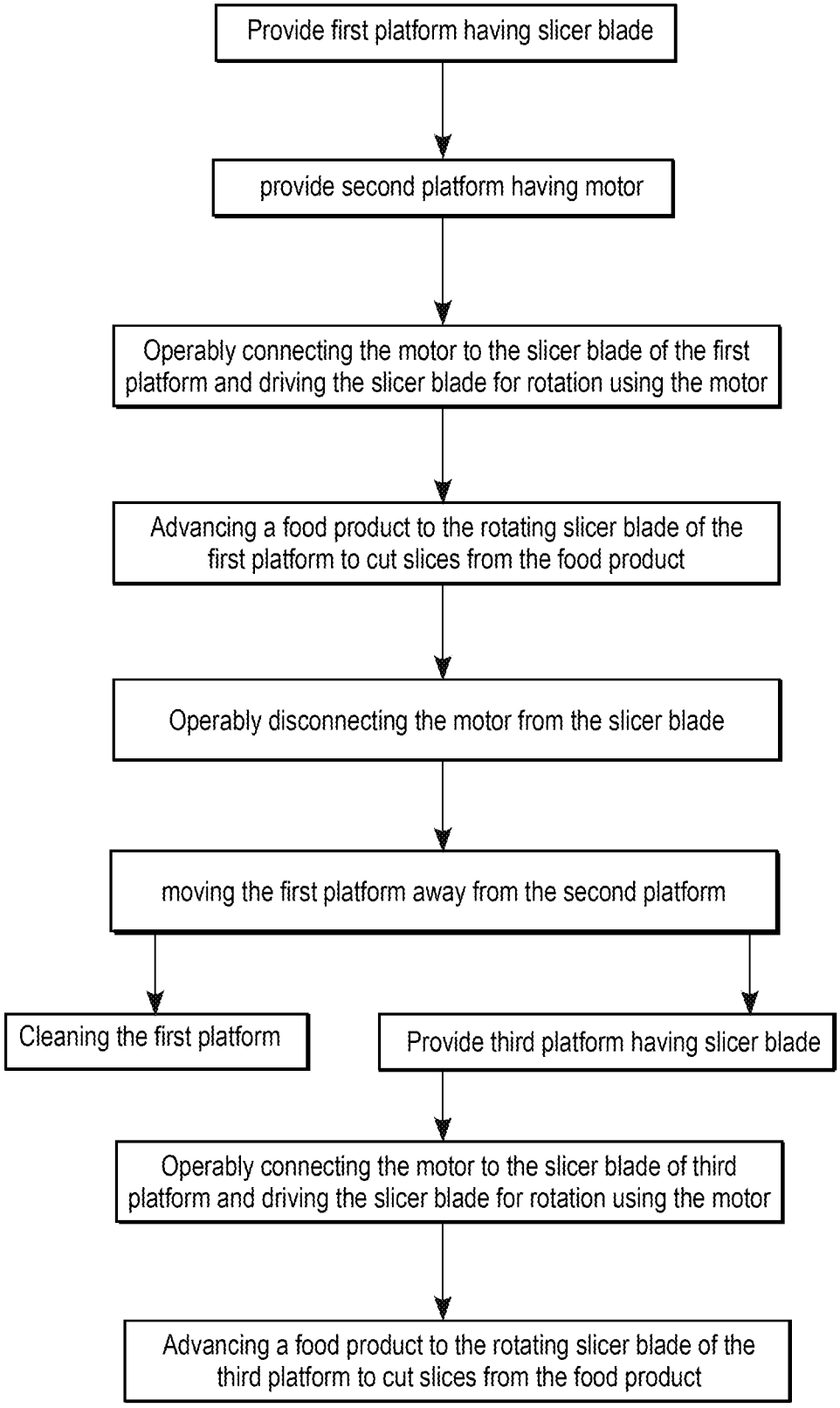
FIG. 3 is a flow diagram of methods for using the system of FIG. 1 to cut food slices from a larger portion of food product.

Exemplary embodiments of systems and methods for cutting slices of food products from larger portions of food product while facilitating cleaning or sanitization and reducing down-time are described herein and illustrated in FIGS. 1-3. In a first aspect, the system is modular in order to permit ready separation of the components requiring more frequent cleaning from those components that do not. Further, electronic components can be associated with the components that do not require as frequent cleaning, thereby facilitating the cleaning of those components that do require more frequent cleaning.

Turning to one exemplary embodiment, illustrated schematically in FIGS. 1 and 2, the system 10 is modular and includes a first platform 12 and a second platform 14. The first platform 12 and the second platform 14 can be operably disconnected from each other so that the second platform 14 and the components associated therewith can be moved away from the first platform 12 for cleaning or other maintenance. When the second platform 14 is moved away from the first platform 12, a substitute second platform 14 (hereinafter referred to as a third platform) can be operably connected to the first platform 12. The third platform can be functionally identical to the second platform 14. This advantageously permits the first platform 12 and its components to be utilized in conjunction with the third platform with minimized down-time while the second platform 14 is being cleaned.

The first platform 12 includes components that do not need cleaning as frequently or that would need to be protected during cleaning. These components include a motor 18 operably connected to a driving shaft 22 for rotating the driving shaft 22. Also included is a support 24 for the driving shaft 22 spaced from the motor 18 and a controller 20. A motor for operating a conveyor 32 of the second platform 14 may also be provided as part of the first platform 12. Other drive mechanisms can be incorporated into the first platform 12. Sensors, such as for sensing the placement and positioning of the product, and other electronics can optionally be provided, and may be part of the first platform 12. Some or all of the components of the first platform 12 may be provided in a housing 26 which can facilitate separation of areas with food contact from those areas lacking food conduct. The first platform 12 can be supported by a framework 16, and may be stationary or may be configured to be readily moved.

The second platform 14 includes components for which it is desirable to provide more frequent cleaning, such as those components that regularly contact food products. These components include a slicer blade 30 and the conveyor 32 for advancing the food product toward the slicer blade 30. The conveyor 32 may be of the belt type, or any other type suitable for use with commercial food processing equipment. A driven shaft 34 may be attached to the slicer blade 24 such that rotation of the driven shaft 34 causes the slicer blade 24 to rotate. The slicer blade 24 may be disposed in a housing 38 having an opening 40 through which the food product can be advanced toward the slicing blade 24 and an opposite opening through which the sliced food product can exit the housing. A jump conveyor, stacking conveyor, or other mechanisms for controlling the slices of food product downstream of the slicer blade 24 can also be part of the second platform 14. The slicer blade 24, housing 38 and driven shaft 34 of the second platform 14 can be supported on a framework 28 that is configured to be readily moved, such as by having selectively lockable wheels or the like.

Preferably, the number of physical connections between the first and second platforms is minimized in number and/or the types of physical connections are readily connected and disconnected. For example, quick connect and disconnect features can be used for joining electrical wires or controllers, as well as for mechanical components. Anchor pins and/or alignment pins and associated receiving apertures can also be provided, such as in the frames, to facilitate proper alignment of the first and second platforms 12 and 14 when connected for operation. With reference to the exemplary embodiment of FIGS. 1 and 2, the first platform 12 and second platform 14 can be operably connected by coupling the driving shaft 22 and the driven shaft 34 such that rotation of the driving shaft 22 (via the motor 18) causes the driven shaft 34 (and hence the slicing blade 30) to rotate. A coupling 36 can be provided for joining the two shafts 22 and 34, and may be in the form of a collar that can be clamped to the adjacent ends of the shafts 22 and 34. To this end, the adjacent ends of the shafts 22 and 34 may be splined and may cooperate with corresponding structures of the coupling 36. A bolt or quick-release clamp can be used to quickly disconnect the coupling 36. However, other suitable couplings can also be used.

The system 10 optionally includes integrated heating elements in a variety of locations to provide for localized sterilization. Locations amenable to inclusion of the heating elements include seal areas, gaps where housings or other structures are not continuously welded and other areas where it can be desirable to provide for localized sterilization. The heating elements are preferably contact-type heaters, which may be formed of a high resistance heating element, and are connected to the controller. The heating elements could also use infrared energy to heat the substrate. The integrated heating elements can provide targeting heating, such as about 165-180 degrees Fahrenheit, for heating the substrate for select periods of time, such as about 30 minutes. A thermocouple or other feedback mechanism can be associated with the substrate to provide feedback to the controller for adjusting the output of the integrated heating elements. They optionally may be capable of independent operation and variable heat application. Preferably, the integrated heating elements provide for localized heating without significantly raising the temperature of adjacent areas. In the exemplary embodiment, an integrated heating element 42 is provided adjacent to a connection point between the motor 18 and the driving shaft 22 or an opening in the motor housing 18.

Another integrated heating element 44 can be provided adjacent the support 24 for the driving shaft 22. Another integrated heating element 46 can be provided adjacent to an opening in the housing 38 of the slicing blade 30, where the driven shaft 34 passes through. Other locations can include inside bearing areas (such as shaft supports or conveyor components) and joints (such as lap joints) in the housings or internal components.

Turning now to an exemplary method of operating the system to cut slices of food product from a larger portion of food product, and with reference to FIG. 3, the first platform 12, having the motor 18, is provided, as is the second platform 14, having the slicing blade 30. The slicing blade 30 is operably connected to the motor 18 such that rotation of the motor 18 causes the slicing blade 30 to rotate. In the exemplary embodiment of FIGS. 1 and 2, one or more shafts 22 and 34 are coupling together to operably connect the motor 18 and the slicing blade 30. Next, the larger portion of the food product is advanced toward the slicing blade 30. In the exemplary embodiment of FIGS. 1 and 2, the conveyor 32 is operated to advance the larger portion of the food product. When it is desired to clean or otherwise maintain the slicing blade 30, the conveyor 32, and/or other components associated with the second platform 14, the slicing blade 30 is operably disconnected from the motor 18. As described above with reference to FIGS. 1 and 2, this can involve decoupling the shafts 22 and 34. Other components, such as electronics, can also be disconnected. The second platform 14 can then be moved away from the first platform 12. Optionally, a third platform (functionally identical to the second platform 14) can be provided. The third platform can be moved into the place vacated by the second platform 14 and operably connected to the first platform 12 in much if not the same manner as the second platform 14. The third platform can have a conveyor and slicing blade, and the slicing process can resume using the first platform 12 and the third platform instead of the first platform 12 and the second platform 14. This substitution of equipment can be continued as desired, and multiple replacements can be provided to permit the minimization of down-time associated with the first platform 12.

The drawings and the foregoing descriptions are not intended to represent the only forms of the systems and methods. While one suitable arrangement is diagrammatically illustrated in FIGS. 1 and 2, the inventions described herein can be applied to other slicing arrangements. Changes in form and in proportion of parts, as well as the substitution of equivalents, are contemplated as circumstances may suggest or render expedient.

The invention claimed is:

1. A modular slicing system for cutting slices of food from a larger piece of food, the modular slicing system comprising:

a slicer blade for cutting slices of food from a larger piece of food, the slicer blade being operably connected to a driven shaft;

a conveyor for advancing the meat log toward the slicer blade;

a motor operably connected to a driving shaft for driving the driving shaft for rotation;

a coupling selectively joining the driven shaft and the driving shaft, thereby permitting the driving shaft to drive the driven shaft and the slicer blade for rotation;

a first platform for supporting the slicer blade and the conveyor; and a second platform for supporting the motor independent of the first platform such that the first platform, along with the slicer blade and the conveyor, can be moved away from the second platform, along with the motor, when the coupling between the driven shaft and the driving shaft are decoupled.

2. The modular slicing system of claim 1, wherein a controller is operably connected to the motor for controlling operation of the motor, the controller being supported by the second platform.

3. The modular slicing system of claim 2, wherein an infeed gripper is supported by the second platform for controlling at least in part the infeed of a larger piece of food to the conveyor, the infeed gripper and the conveyor being operably connected to the controller.

4. The modular slicing system of claim 2, wherein the slicer blade is disposed within a housing, the housing having an upstream opening aligned with the conveyor for the introduction of a larger piece of food into the housing and a downstream opening through which slices of food from the larger piece of food can exit the housing.

5. The modular slicing system of claim 4, wherein one of the drive and drive shafts extends at least partially into the housing through a shaft opening of the housing.

6. The modular slicing system of claim 5, wherein an integrated heating element is disposed adjacent the shaft opening of the housing to provide localized sterilization.

7. The modular slicing system of claim 2, wherein a support for the driving shaft is disposed on the second platform between the coupling and the motor.

8. The modular slicing system of claim 7, wherein an integrated heating element is disposed adjacent the support for the driving shaft to provide localized sterilization.

9. The modular slicing system of claim 1, wherein at least one integrated heating element is disposed to provide localized sterilization.

10. The modular slicing system of claim 1, wherein the at least one integrated heating element is disposed adjacent one of a support for the driving shaft, a support for the driven shaft, the slicing blade and the motor to provide localized sterilization.

* * * * *